US006302017B1

(12) United States Patent
Kawai et al.

(10) Patent No.: US 6,302,017 B1
(45) Date of Patent: Oct. 16, 2001

(54) STENCIL PRINTING MACHINE AND THE METHOD THEREOF

(75) Inventors: Muneaki Kawai; Masao Suzuki; Hirotaka Kaneda, all of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/588,551

(22) Filed: Jun. 7, 2000

(30) Foreign Application Priority Data

Jun. 17, 1999 (JP) ..... 11-171102

(51) Int. Cl.[7] ..... B41L 13/06
(52) U.S. Cl. ..... 101/128.4; 101/477
(58) Field of Search ..... 101/118, 114, 101/116, 128.4, 129, 477; 400/648, 649, 659

(56) References Cited

U.S. PATENT DOCUMENTS 5,224,419 * 7/1993 Fukai ..... 101/128.4
5,613,437 * 3/1997 Motoe et al. ..... 101/128.4
5,713,279 * 2/1998 Iida et al. ..... 101/128.4
5,970,869 * 10/1999 Hara et al. ..... 101/128.4

FOREIGN PATENT DOCUMENTS 0 888 901 A1 1/1999 (EP) .
02098480 4/1990 (JP) .
06270378 9/1994 (JP) .
08090747 4/1996 (JP) .
10329401 12/1998 (JP) .

* cited by examiner

*Primary Examiner*—Ren Yan
(74) *Attorney, Agent, or Firm*—Nath & Associates PLLC; Gary M. Nath; Harold L. Novick

(57) ABSTRACT

A stencil printing machine comprises a feed-per-revolution detecting unit for detecting a feed-per-revolution of the stencil sheet on the basis of the rotation amount of the detecting roller for a given time; and a control unit for calculating a driving speed of the platen roller correspondingly to the feed-per-revolution detected by the feed-per-revolution detecting unit and such a standard feed-per-revolution that the platen roller should be originally transported for the given time, and then controlling the driving unit in the manner that the driving unit rotates the platen roller at the calculated driving speed. Upon stencil-making, the error of the feed-per-revolution of the stencil sheet is corrected and then the driving of the platen roller is controlled.

10 Claims, 7 Drawing Sheets

STENCIL PRINTING MACHINE AND THE METHOD THEREOF

BACKGROUND OF THE INVENTION

1. Field of the Invention

The present invention relates to a stencil printing machine in which a desired image is heat-sensitively made in a stencil sheet to make a stencil, and an ink is transferred from perforated image areas of the heat-sensitively made stencil to a printing sheet to perform stencil printing, and relates in particular to a technique for improving reproducibility of images.

2. Description of the Related Art

Stencil printing as follows is generally known: a stencil sheet wherein perforated areas are heat-sensitively made to form a desired image is set onto a cylindrical printing drum and then an ink supplied from the inside of the printing drum is transferred through the perforated areas of the stencil sheet to a printing sheet so as to perform desired printing.

More specifically, when in such a type of stencil printing machine a stencil sheet wound in a roll form is transported between a thermal head and a platen roller by a transporting mechanism, the stencil sheet is heat-sensitively perforated therebetween to make a stencil. The thus made stencil is cut into a predetermined length. The cut stencil is wound around a printing drum and attached to the drum. When the made stencil is attached to the printing drum, an ink is supplied from the inside of the drum to the surface thereof with the rotation of the drum. In this way, the ink is forced out from the perforated areas of the stencil.

In synchronization with the above-mentioned operation, a printing sheet fed from a paper feed tray passes through the area between the printing drum and a press roller to which a given pressure is applied, the ink passes through the perforated areas of the made stencil and is transferred to the printing sheet. In this way, a desired image is printed on the printing sheet. The image-printed sheet is then discharged to a sheet discharge tray.

In such stencil printing machines in the prior art, perforations for forming a desired image are heat-sensitively made in a stencil sheet to make a stencil if the stencil sheet in a roll form is always transported at a constant speed.

However, the platen roller arranged opposite the thermal head to be contact-pressed against the head is usually made of an elastic member such as rubber in order to give sufficient transporting force to the stencil sheet. Therefore, the outer diameter of the platen roller changes with a change in surrounding temperature. If the platen roller is controlled at any time so as to have a constant rotating speed, the feed-per-revolution of the stencil sheet transported between the thermal head and the platen roller changes. As a result, the image made by perforating the stencil sheet heat-sensitively expands and contracts, causing a problem that a desired image cannot be made in the stencil sheet.

Such a problem based on the temperature-change can be relieved, for example, by setting a temperature sensor near the platen roller and controlling the driving speed of the platen roller variably on the basis of the temperature-change detected by this temperature sensor.

However, the change in the outer diameter of the platen roller is caused by not only the above-mentioned temperature-change but also the change of the roller itself with the passage of time based on use for a long time. For this reason, only by detecting the temperature-change by the temperature sensor and controlling the driving speed of the platen roller variably, it is impossible to remove an error based on the change with the passage of time and control the feed-per-revolution of the stencil sheet into a constant value.

The platen roller contact-presses against the thermal head at a given grip force. If this grip force changes by the above-mentioned temperature-change or change with the passage of time, the slip amount of the stencil sheet changes. This change in the slip amount also causes the same problem as above.

As described above, stencil printing machines in the prior art cannot relieve the accidental error of the feed-per-revolution of the stencil sheet, based on external factors such as an environmental factor (temperature-change) and a physical factor (change with the passage of time). Thus, an image formed in the stencil sheet expands and contracts. As a result, even if the life of the thermal head does not come to an end, it is impossible to solve the above-mentioned problem of expansion and contraction of the image without exchange of only the platen roller.

SUMMARY OF THE INVENTION

The present invention has been achieved in order to overcome the above-mentioned problems. An object of the invention is to provide a stencil printing machine making it possible to keep the feed-per-revolution of a stencil sheet upon making a stencil and reduce the expansion and contraction of a formed image so as to make the stencil having a desired image.

Another object of the present invention is to provide a stencil printing method making it possible to keep the feed-per-revolution of a stencil sheet upon making a stencil and reduce the expansion and contraction of a formed image so as to make the stencil having a desired image.

According to the stencil printing machine and the stencil printing method of the present invention, the driving of a platen roller is indirectly detected through a roller member having a far smaller change in its outer diameter based on temperature-change and change with the passage of time than the platen roller and having a small load to a stencil sheet. From the result of this detection, the difference from the set speed of the platen roller is calculated. On the basis of the result of this calculation, the driving speed of the platen roller is corrected. Therefore, it is possible to reduce the expansion and contraction of the image of a made stencil, which are brought into a problem in the prior art, caused by the change in the outer diameter of the platen roller based on the temperature-change and the change with the passage of time, and caused by the change in the grip force to the stencil sheet. Thus, it is possible to improve the reproducibility of the image that is heat-sensitively formed in the stencil sheet.

Other and further objects and features of the present invention will become obvious upon understanding of the illustrative embodiments about to be described in connection with the accompanying drawings or will be indicated in the appended claims, and various advantages not referred to herein will occur to one skilled in the art upon employing of the invention in practice.

DETAILED DESCRIPTION OF THE PREFERRED EMBODIMENTS

Figure 1:
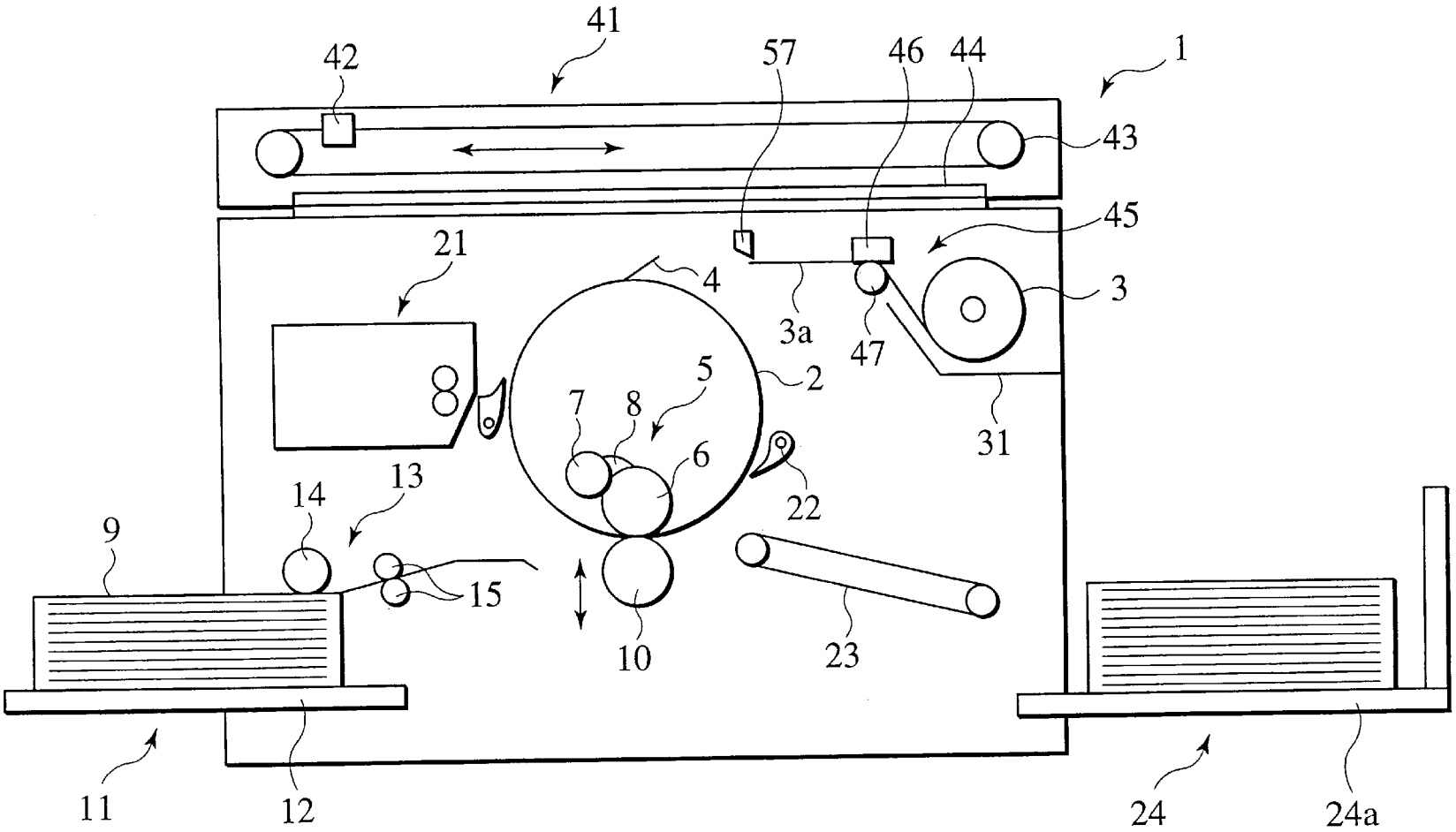
FIG. 1 is a schematic view showing a structure of a stencil printing machine according to an embodiment of the present invention.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

As shown in FIG. 1, a stencil printing machine 1 has both of a stencil making function for perforating a stencil sheet heat-sensitively by a thermal head to make a stencil, and a printing function for performing stencil printing onto a printing sheet, using the made stencil. As the stencil sheet as a printing medium, there is used a sheet wherein a porous tissue is laminated on a heat-sensitive film.

The stencil printing machine 1 is provided with a cylindrical printing drum 2 supported so as to rotate around a central axis of the drum 2 itself. The printing drum 2 has a porous structure, and has on its outer peripheral surface a clamp member 4 which engages with one end 3*a* of a stencil sheet 3. The printing drum 2 is intermittently or continuously driven by driving force of a printing drum driving motor (not illustrated) so as to rotate in the counterclockwise direction in FIG. 1.

A printing ink supplying means 5 is disposed inside the printing drum 2. The printing ink supplying means 5 is arranged in such a manner that its outer peripheral surface contacts the inner peripheral surface of the printing drum 2. The printing ink supplying means 5 has a squeegee roller 6 that is rotatable around its central axis, and a doctor roller 7 having a given interval from the outer peripheral surface of the squeegee roller 6 and extending along the generatrix direction of the squeegee roller 6. The squeegee roller 6 is driven to rotate in the same direction as the printing drum 2, in synchronization with the rotation of the drum 2, so that the printing ink supplying means 5 causes the printing ink of an ink pool 8 to be supplied to the inner peripheral surface of the printing drum 2.

The printing ink of the ink pool 8 passes through the gap between the squeegee roller 6 and the doctor roller 7, with the rotation of the squeegee roller 6. At this time, a printing ink layer having a uniform thickness is formed on the outer peripheral surface of the squeegee roller 6. With the rotation of the squeegee roller 6, the printing ink layer is supplied to the inner peripheral surface of the printing drum 2 and then is used for printing. A press roller 10, which is a roller member for pressing the printing sheet 9 at a given pressure onto the outer peripheral surface of the printing drum 2, is located outside the drum 2 opposing the squeegee roller 6.

In FIG. 1, a paper feed section 11 is disposed diagonally to the lower left of the printing drum 2. The paper feed unit 11 has a paper feed tray 2 on which printing sheets 9 are stacked. The paper feed tray 12 is moved up and down by a driving unit (not illustrated) in accordance with the stack amount of the set printing sheets 9.

A paper feed mechanism 13 is arranged near the paper feed tray 12. The paper feed mechanism 13 is composed of a paper feed roller 14 made of, for example, rubber, and a pair of timing rollers 15. The paper feed roller 14 picks up the printing sheets 9 stacked on the paper feed tray 12, one by one, from the top sheet thereof, and transports the sheet toward the timing rollers 15. The timing rollers 15 temporarily keeps the printing sheet 9 transported from the paper feed roller 14 in the state that the sheet 9 is loose. At an appropriate timing, the printing sheet 9 is fed out to the gap between the printing drum 2 and the press roller 10.

A stencil disposal unit 21 is located about the printing drum 2 and over the paper feed tray 12. With the rotation of the drum 2, the stencil disposal unit 21 exfoliates the used stencil wound on the outer peripheral surface of the printing drum 2, and accommodates the used stencil.

A printing sheet separating hook 22 is disposed about the printing drum 2 and opposite the paper feed mechanism 13. The printing sheet separating hook 22 is a member for taking off the image-printed sheet, which is in the state that printing has been finished, from the printing drum 2. The image-printed sheet exfoliated by the printing sheet separating hook 22 is transported toward a sheet discharge section 24 by a sheet discharge unit 23 composed of a belt conveyer device. The sheet discharge section 24 has a sheet discharge tray 24*a* on which the image-printed sheet transported by the sheet discharge unit 23 is stacked and accommodated.

Above the sheet discharge unit 23, a continuous-sheet-form stencil sheet 3 wound in a roll form is stored in a stencil sheet storing section 31. In the state that the stencil sheet 3 is set in the stencil sheet storing section 31, braking force is applied to the roll core of the sheet 3. A tension is given to the stencil sheet 3 by a tension giving unit (not illustrated).

An original reading section 41 is disposed above the printing drum 2. The original reading section 41 is composed of, for example, a scanner of a flat bed type, and has an image sensor 42 as reading elements such as CCD, and a belt-style moving mechanism 43 for moving the image sensor 42 in the directions of arrows in FIG. 1 (the vertical scanning direction). If an original is set onto an original loading table 44 in this original reading section 41, the moving mechanism 43 is driven to move the image sensor 42 in the vertical scanning direction at a given speed, thereby optically reading the content of the original one line by one line.

Figure 2:
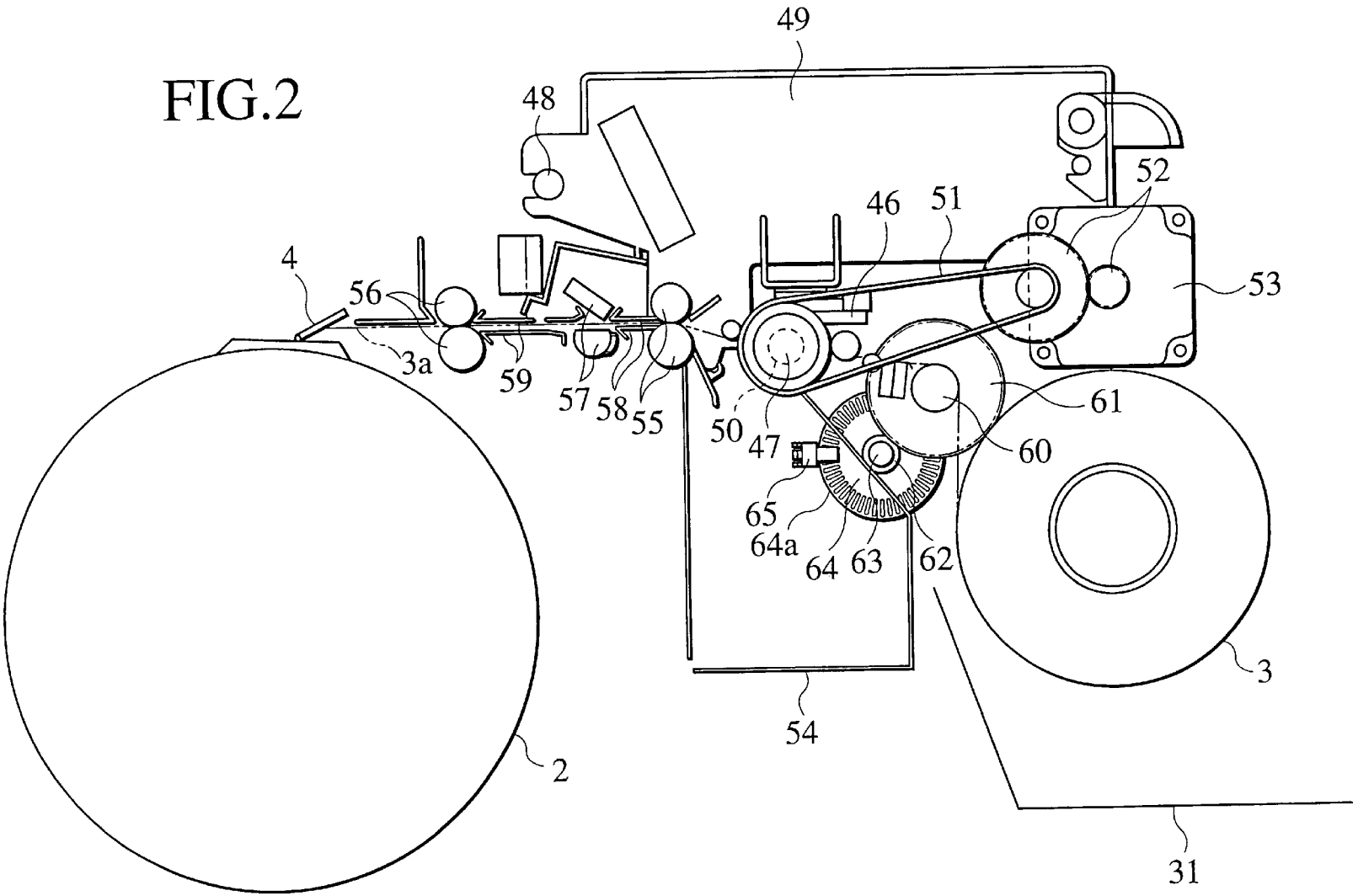
FIG. 2 is a side view showing a transporting mechanism of a stencil making section according to the embodiment of the present invention.
Figure 3:
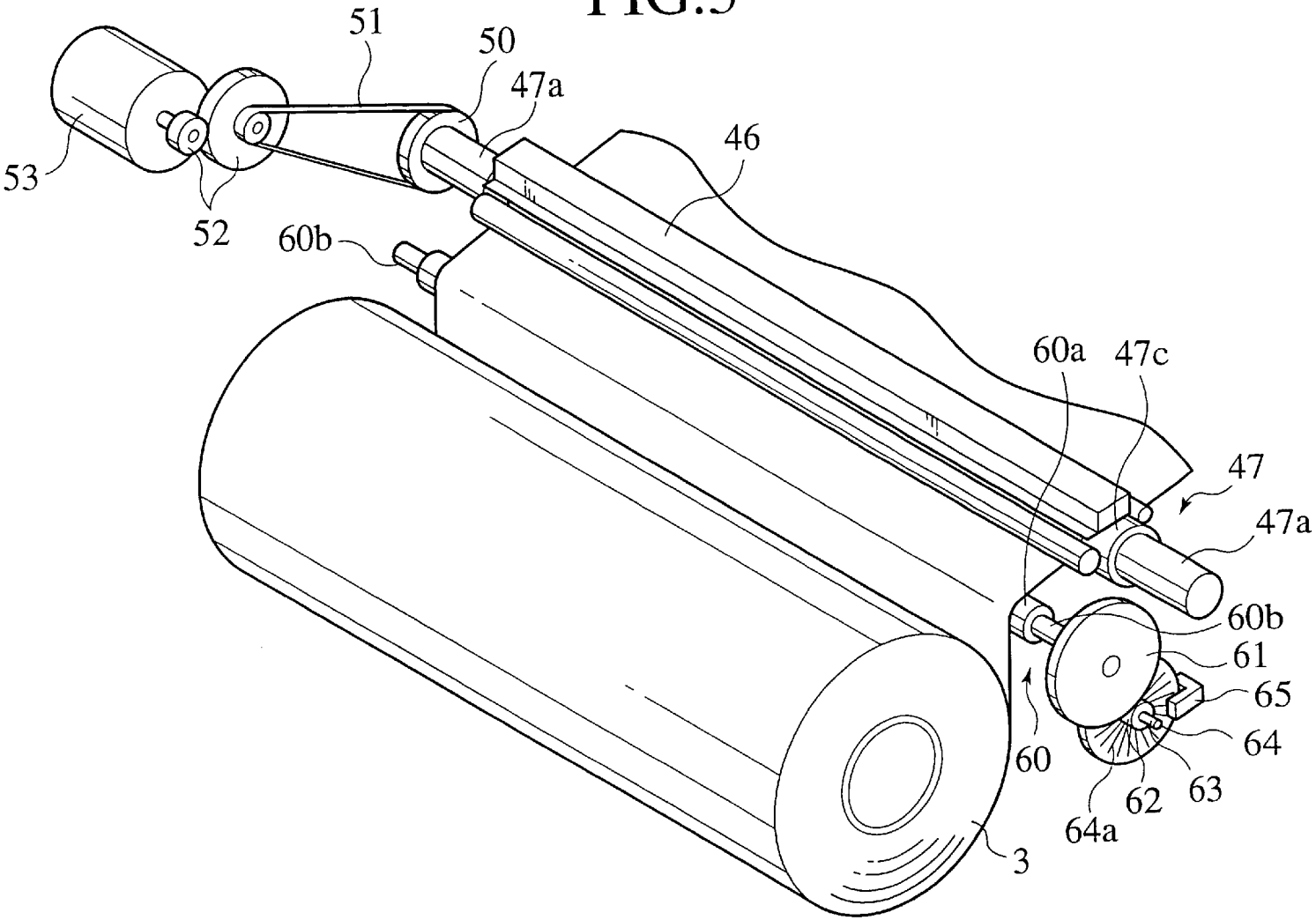
FIG. 3 is a perspective view showing the transporting mechanism of the stencil making section according to the embodiment of the present invention.

A stencil making section 45 of the stencil printing machine is arranged between the stencil sheet storing unit 31 and the printing drum 2. As shown in FIGS. 2 and 3, the stencil making section 45 has a thermal head 46 and a platen roller 47 at a position opposite the thermal head 46. In the stencil making section 45, a stencil is heat-sensitively made from the stencil sheet 3 supplied from the stencil sheet storing section 31.

The thermal head 46 is a member in which plural heating elements that generate heat selectively in accordance with image data signals read by the original reading section 41 are arranged at regular intervals along a single lateral row, that is, along the horizontal scanning direction. As shown in FIG. 2, the thermal head 46 is attached to a thermal head frame 49, which is set onto the upper surface of a body frame through a supporting axis 48 in such a manner that the frame 49 can be opened and shut. The thermal head 46 is in a slender plate form, and is arranged in parallel to the width direction of the stencil sheet 3 (the horizontal scanning direction) in the manner that the head 46 contacts the upper surface of the transported stencil sheet 3. The thermal head 46 can be moved to approach the platen roller 47 and go away from the roller 47 by a driving mechanism (not illustrated). That is, the thermal head 46 is brought into contact with the platen roller 47 upon perforating the stencil sheet 3, and goes away from the platen roller 47 after the perforating.

Figure 4:
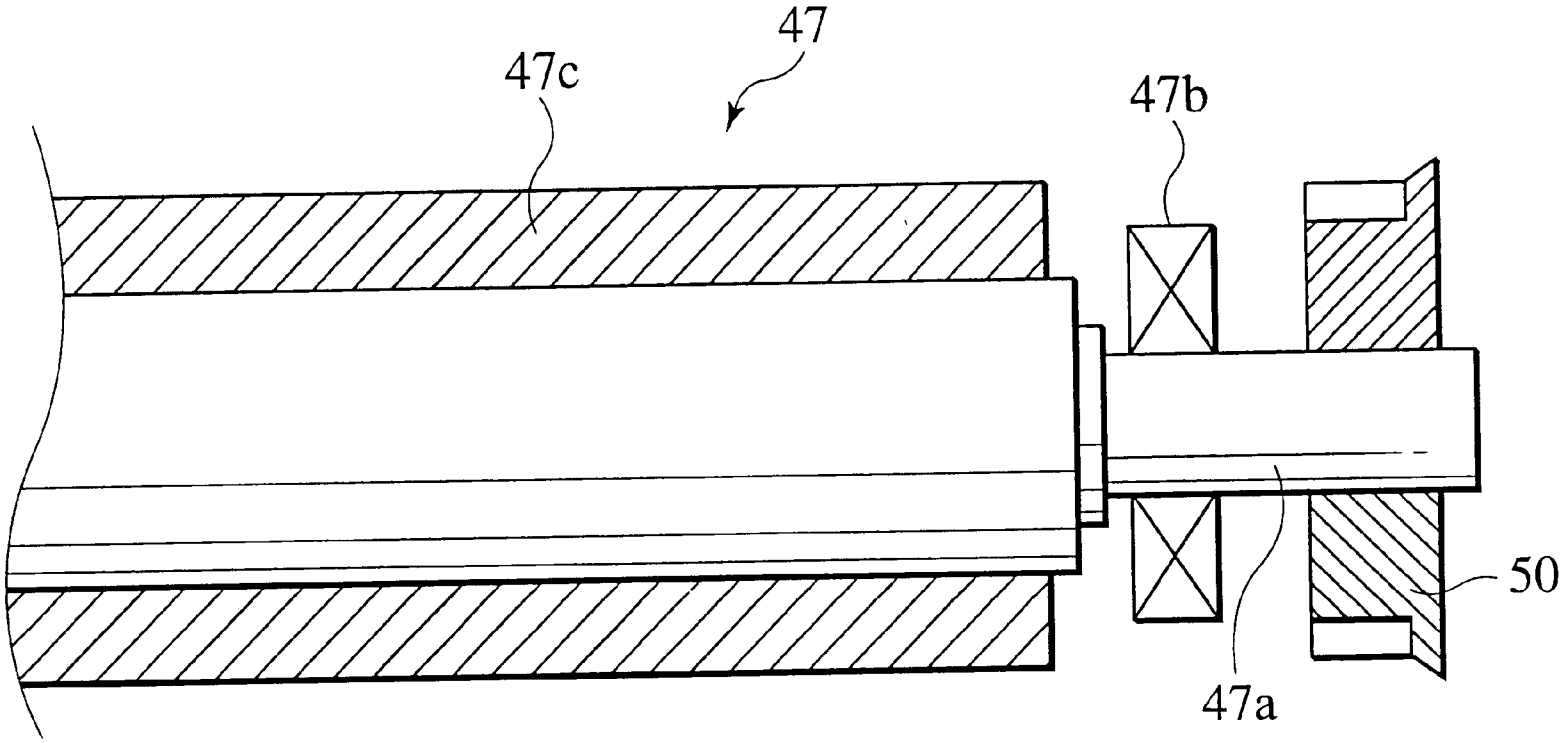
FIG. 4 is a sectional view showing a platen roller in the transporting mechanism according to the embodiment of the present invention.

As shown in FIG. 2, the platen roller 47 is located inside the body frame below the thermal head 46. More specifically, as shown in FIG. 4, in the platen roller 47 a cylindrical roller member 47*c* made of an elastic material such as rubber is fitted around the outer peripheral surface of a single slender axial core 47*a*, which is composed of a cylindrical metal member. In this way, sufficient transporting force is given to the stencil sheet 3 when the stencil sheet 3 is sandwiched between the roller member 47*c* and the thermal head 46 and transported.

A platen driving pulley 50 is fitted to one end of the axial core 47*a* of the platen roller 47. The platen driving pulley 50 is pulse-driven through a driving belt 51 and a speed reduction mechanism 52 composed of plural gears. For example, the pulley 50 is connected to a driving motor 53 as a driving means, such as a stepping motor, and cooperates with the motor 53. The rotation driving force of the driving motor 53, which is controlled by a control means 102 that will be described later, is transmitted through the speed reduction mechanism 52 and the driving belt 51 to the platen driving pulley, so that the platen roller 47 is driven and rotated at a given speed.

When the thermal head frame 49 is shut, the face of the heating elements of the thermal head 46 is brought into contact with the platen roller 47. The stencil sheet 3 sandwiched between the thermal head 46 and the platen roller 47 is transported by the rotation of the platen roller 47 and simultaneously the stencil sheet 3 is heat-sensitively converted to a stencil by the thermal head 46.

A storing box 54 for temporarily storing the stencil 3 that has been heat-sensitively made by the thermal head 46 is disposed below the thermal head 46 and the platen roller 47 inside the body frame.

Between the printing drum 2 and the platen roller 47 are arranged two pairs 55 and 56 of transporting rollers. Each of them is composed of a driving roller and a trailing roller, between which the made stencil 3 is sandwiched and transported in synchronization with the rotation of the printing drum 2. Between these two roller pairs 55 and 56 are set up a cutter unit 57 for cutting the stencil 3 at the time when the made stencil 3 is wound at a given amount onto the outer peripheral surface. Stencil guide plates 58 and 59 are laid between the cutter unit 57 and each of the two transporting roller pairs 55 and 56. The stencil guide plates 58 and 59 are members for regulating the movement of the upper and lower surfaces of the made stencil 3 and guiding the transportation of the stencil 3 when the stencil 3 stored in the storing box 54 is transported and attached to the printing drum 2.

As shown in FIGS. 2 and 3, a detecting roller 60 that contacts the stencil sheet 31 at a given pressure is arranged between the platen roller 47 and the stencil sheet 3 stored in the stencil sheet storing section 31 that is at the upstream side of the platen roller 47. The detecting roller 60 trail-rotates with the transportation of the stencil sheet 3 by the rotation of the platen roller 7.

Figure 5:
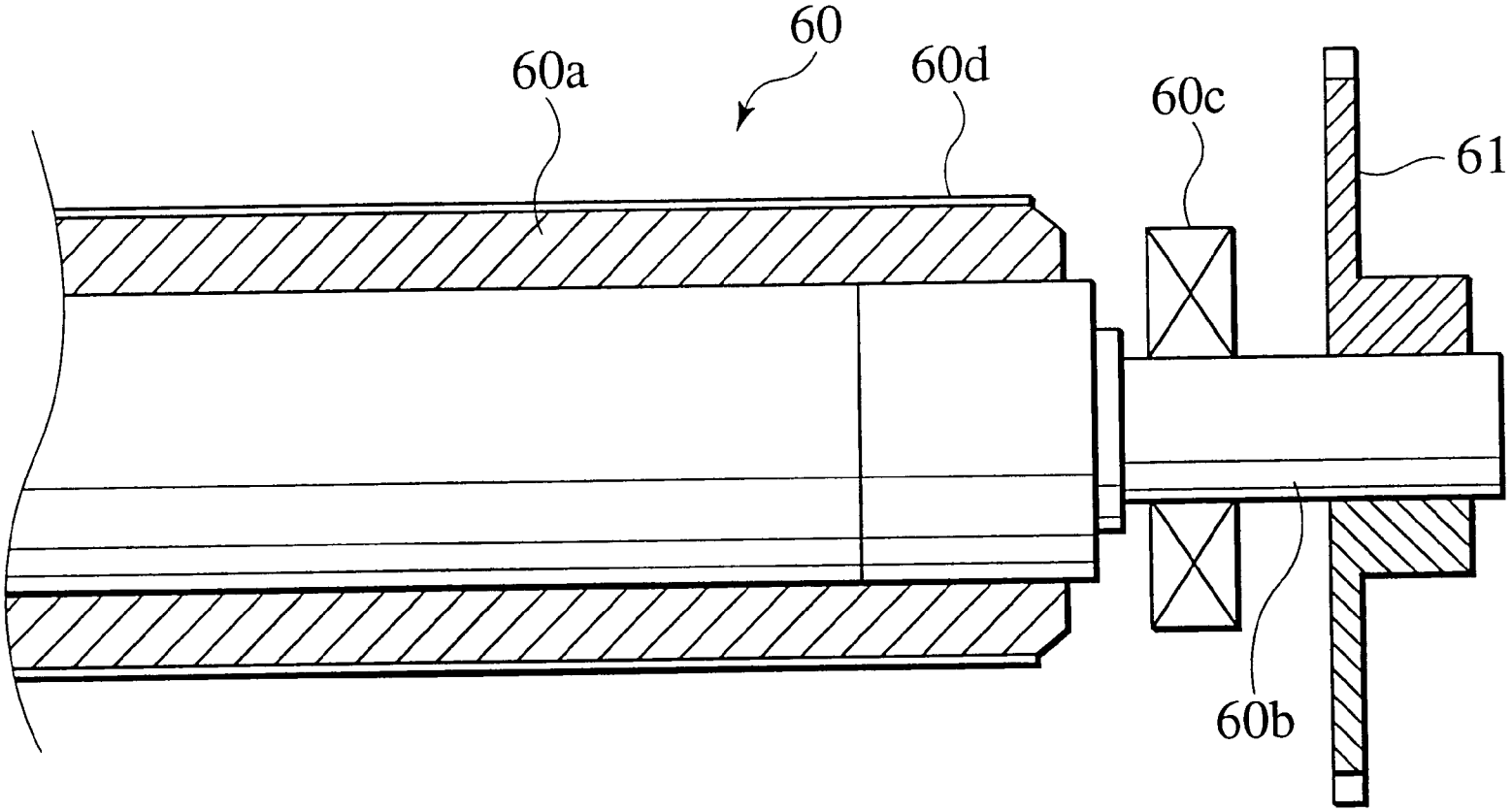
FIG. 5 is a sectional view showing a detecting roller in the transporting mechanism according to the embodiment of the present invention.

More specifically, as shown in FIG. 5, the detecting roller 60 is made by fixing an axial core 60*b* made of a metal into hollow portions of both ends of a roller 60*a* composed of a cylindrical metal pipe by press-fit or adhesion, and integrating them. In this way, the detecting roller 60 is made light and further a load on the stencil sheet is reduced. Thus, a change in the outer shape of the detecting roller 60, based on temperature-change or change with the passage of time, becomes far smaller than that in the outer shape of the platen roller 47.

The roller 60*a* is axially supported, through bearings 60*c* set to respective axial cores 60*b*, by the body frame in the manner that the roller 60*a* can be rotated. In order to prevent the slip of the stencil sheet 3 upon transportation, the surface of the roller 60*a* is made up to a fine unevenness surface 60*d* by, for example, sandblasting. A transmission gear 61 having a given diameter is fitted to an end of one axial core 60*b*. A transmission gear 62 having a smaller diameter than that of the transmission gear 61 engages with this gear 61, and is axially supported by the body frame. The gear number of the transmission gear 62 is made smaller than that of the transmission gear 61, so that the rotation of the roller 60*a* transmitted through the transmission gears is increased. An encoder plate 64 is fixed to an axis 63 of the transmission gear 62.

The encoder plate 64 is a member in which a large number of slender slits 64*a* are concentrically made at regular intervals around the axis 63 as a center. The encoder plate 64 is fixed to the axis 63 in the manner that the plate 64 interlocks with the rotation of the transmission gear 62. A feed-per-revolution detecting sensor 65 is set up to the encoder plate 64 in the manner that a part of the slits 64*a* is put between detecting portions of the sensor 65. The feed-per-revolution detecting sensor 65 in the present embodiment is composed of an optical sensor comprising a light projecting element and a light receiving element oppositely arranged, between which slits 64*a* of the encoder plate 64 are sandwiched. In this feed-per-revolution detecting sensor 65, the light receiving element receives light that is radiated from the light projecting element and passes through the slip 64*a* of the encoder plate 64. The sensor 65 then inputs a pulse signal corresponding to the rotation speed of the detecting roller 60 to a control means 102 described later.

The following will describe a processing for reducing the expansion and contraction of an image produced by perforating a stencil sheet according to an embodiment of the present invention heat-sensitively.

Figure 6:
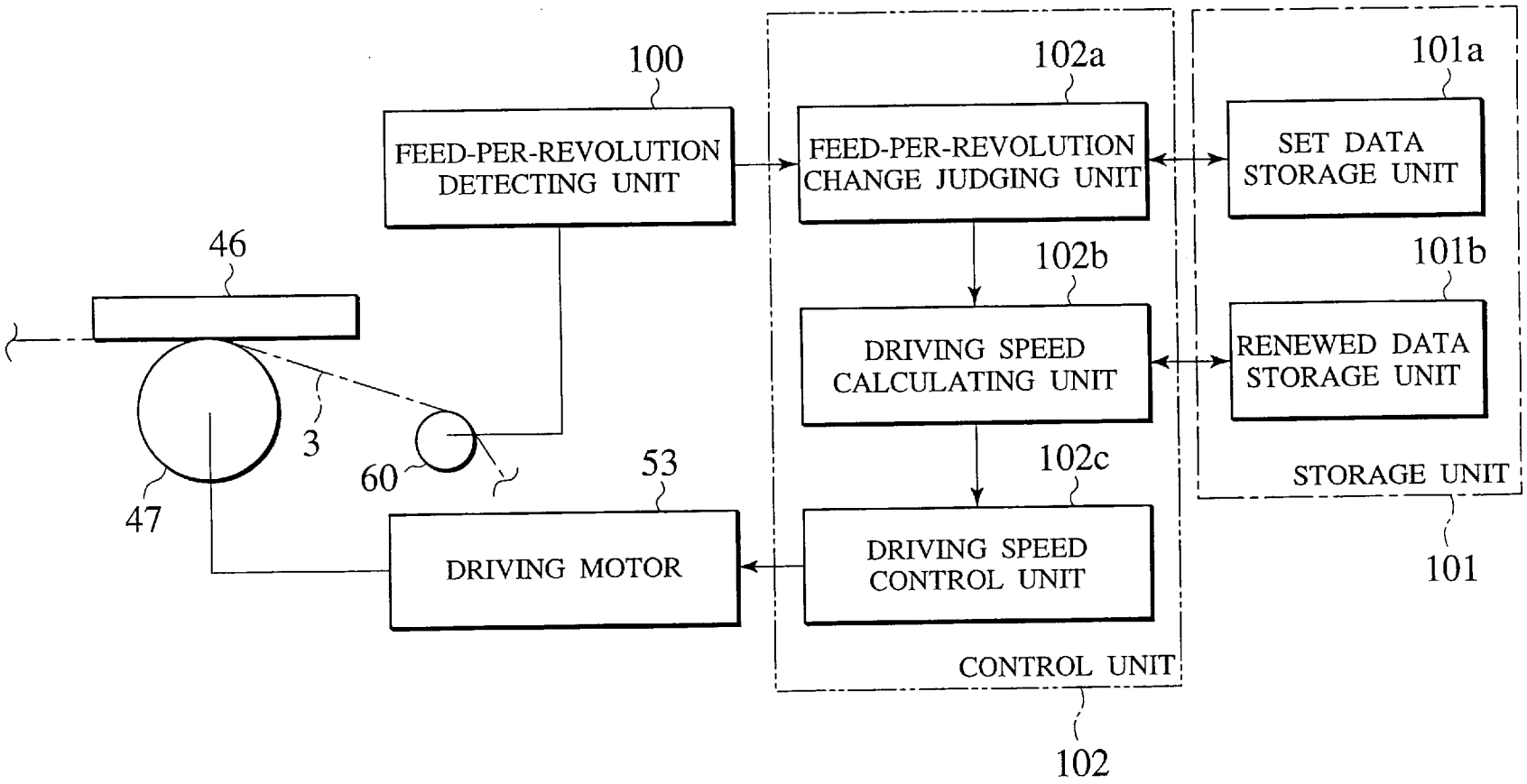
FIG. 6 is a block view showing the structure of the stencil making section according to the embodiment of the present invention.

FIG. 6 is a block view concerning a processing, in the stencil making section 45, for reducing expansion and contraction of an image produced by perforating a stencil sheet.

A feed-per-revolution detecting unit 100 in FIG. 6 is composed of the encoder plate 64 to which the rotation of the detecting roller 60 is transmitted, and the feed-per-revolution detecting sensor 65 that generates pulse signals corresponding to the rotation of the encoder plate 64. To a feed-per-revolution change judging unit 102*a* of the control unit 102, the feed-per-revolution detecting unit 100 outputs the pulse signal which is generated from the feed-per-revolution detecting sensor 65 correspondingly to the rotation of the detecting roller 60 trail-rotated with the transportation of the stencil sheet 3 upon the rotation of the platen roller 47.

A storage unit 101 is composed of, for example, an EEPROM or a FLASHRAM, in which data are not erased when a power source is broken and internal data can be electrically rewritten, and has a set data storage unit 101*a* and a renewed data storage unit 101*b*. In the set data storage unit 101*a*, the pulse count necessary for transporting the stencil sheet 3 by the length of one stencil in the vertical scanning direction by means of the platen roller 47, upon any normal time when there is no change based on external factors, is stored as a set data for each length in the vertical scanning direction of each stencil-making area. Specifically, in the case that the stencil-making area of a single stencil has an A4 size, 200 pulses for 10 seconds are stored as a set data (a driving speed data at an initial time).

In the renewed data storage unit 101*b*, a driving speed data calculated in a driving speed calculating unit 102*b* of the control unit 102 is renewed or stored as a renewed data.

The control unit 102 controls a series of operations of the stencil printing machine 1, and is composed of, for example, a microprocessor. The control unit 102 has the feed-per-revolution change judging unit 102*a*, the driving speed calculating unit 102*b*, and a driving speed control unit 102*c*.

The feed-per-revolution change judging unit 102*a* compares the pulse count of the pulse signal inputted from the feed-per-revolution detecting unit 100 during a period from the start of stencil-making to the moment when a given time passes with the pulse count based on the set data of the set data storage unit 101*a*, to judge whether or not there is a change (difference) of the feed-per-revolution. The given time referred to herein is a time necessary for the following: the platen roller 47 transports the stencil sheet 3 by the length in the vertical direction of the stencil-making area of a single stencil upon any normal time. In the case that the stencil-making area of a single stencil has an A4 size, the feed-per-revolution change judging unit 102*a* compares the pulse count inputted from the feed-per-revolution detecting unit during a period from the start of stencil-making to the moment when 10 seconds passes with the pulse count (200 pulses) of the set data stored in the set data storage unit 101*a*, and then judges whether or not there is a change in the feed-per-revolution from the difference between these pulse counts. The differential data on the pulse counts, which is obtained by judgement of the feed-per-revolution change judging unit 102*a*, is inputted to the driving speed calculating unit 102*b*.

The driving speed calculating unit 102*b* corrects the current driving speed data for the platen roller 47 by the pulse count based on the differential data inputted from the feed-per-revolution change judging unit 102*a*, so as to calculate the driving speed of the platen roller 47 necessary for making a next single stencil. Specifically, if the differential data inputted from the feed-per-revolution change judging unit 102*a* is a positive value, the next driving speed of the platen roller 47 is calculated to be reduced by the differential data from the current driving speed. On the other hand, if the differential data inputted from the feed-per-revolution change judging unit 102*a* is a negative value, the next driving speed of the platen roller 47 is calculated to be increased by the differential data from the current driving speed.

The driving speed control unit 102*c* supplies a pulse signal to a driving motor 53 in the manner that the platen roller 47 is rotated at the driving speed calculated by the driving speed calculating unit 102*b*. In this way, the control unit 102*c* controls the driving speed of the platen roller 47.

Figure 7:
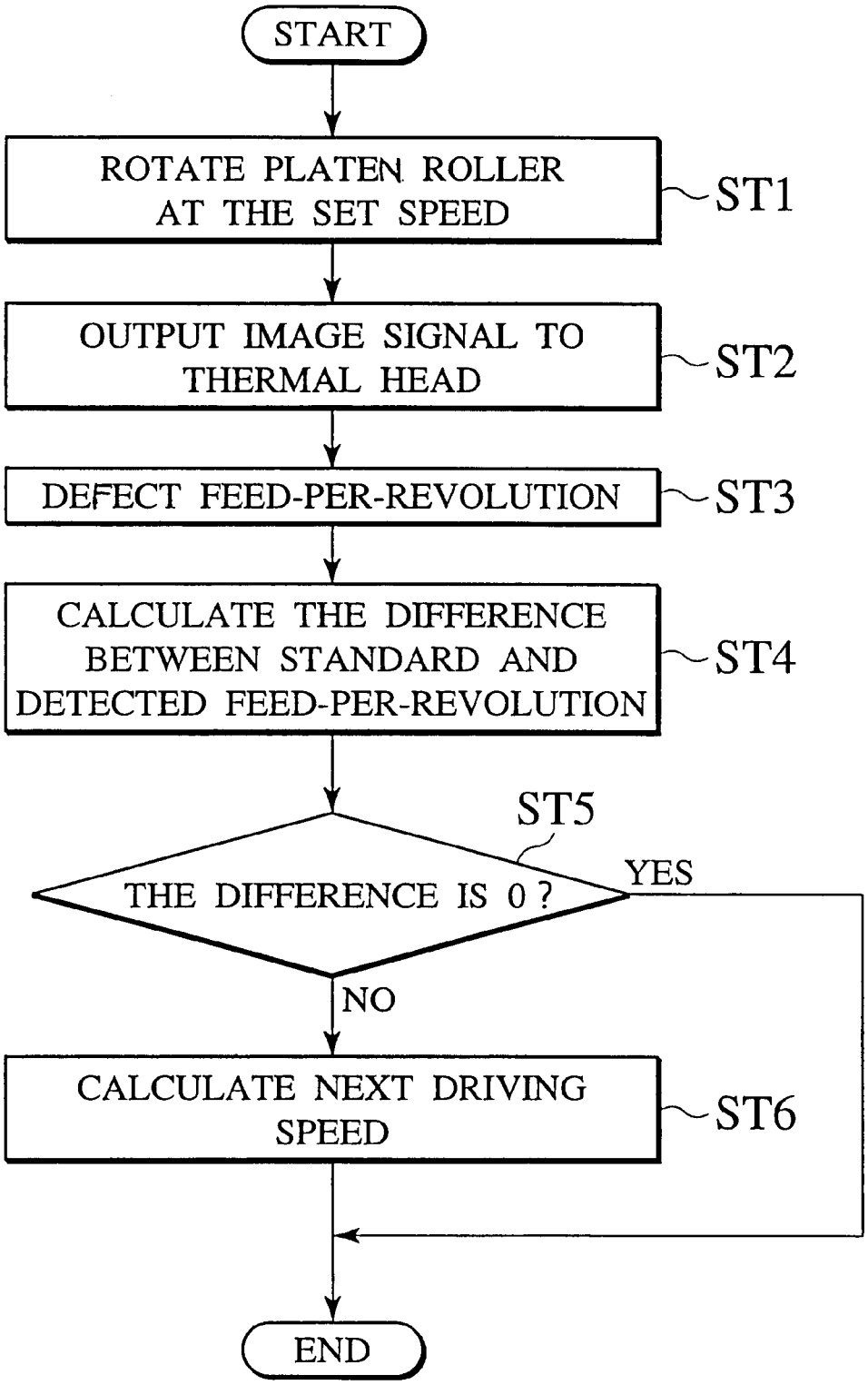
FIG. 7 is a flowchart showing operations of the stencil making section according to the embodiment of the present invention at the time of making a stencil.

Referring to FIG. 7, the following will describe operations of the stencil making section 45 at the time of making a stencil.

Upon an initial operation of the stencil making section 45, a start key for starting stencil-making in an operation panel (not illustrated) is pushed down, so that the platen roller 47 is rotated at the set speed stored in the set data storage unit 101*a* (ST1). In synchronization with the rotation of the platen roller 47, an image signal is outputted to the thermal head 46 (ST2), so that the stencil sheet 3 transported between the thermal head 46 and the platen roller 47 is heat-sensitively perforated to make an image. When a given time passes from the start of the stencil-making, the rotation of the platen roller 47 is stopped. This given time is equal to a time necessary for the transportation of the stencil sheet 3 by the length in the vertical scanning direction of the stencil-making area of the stencil sheet 3 at any normal time when the platen roller 47 has no change based on external factors. For example, the given time is clocked by an inner timer of the control unit 102.

When the detecting roller 60 is trail-rotated with the transportation of the stencil sheet 3 by the rotation of the platen roller 47, the rotation of the detecting roller 60 is transmitted to the encoder plate 64 through he transmission gears 61 and 62. When the encoder plate 64 is rotated with the rotation of the detecting roller 60, the pulse signal corresponding to the rotation of the encoder plate 64 is inputted from the feed-per-revolution detecting sensor 65 to the feed-per-revolution change judging unit 102*a*. In this way, the feed-per-revolution of the stencil sheet 3, accompanying the rotation of the platen roller 47, is detected through the detecting roller 60 (ST3).

The feed-per-revolution change judging unit 102*a* compares the pulse count (a standard feed-per-revolution) of the set data stored in the set data storage unit 101*a* with the pulse count (detected feed-per-revolution) inputted from the feed-per-revolution detecting sensor 65, to calculate the change (difference) therebetween (ST4). In this way, it is judged whether or not the change is zero. If the change calculated by the feed-per-revolution change judging unit 102*a* is not zero (ST5-No), the driving speed calculating unit 102*b* corrects the current driving speed data by the difference based on the change, to calculate a next driving speed data for the platen roller 47 (ST6). The next driving speed calculated at this time is newly stored in the renewed data storage unit 101*b*.

On the other hand, if the change calculated by the feed-per-revolution change judging unit 102*a* is zero (ST5-Yes), the current driving speed data itself is stored as the next driving speed data for the platen roller 47 in the renewed data storage unit 101*b*.

Completion of the above-mentioned operations leads to the end of stencil-making operations for making a single stencil. If the next stencil-making is performed in a stencil-making area having the same length in the vertical scanning direction as the present stencil-making, the driving speed control unit 102*c* supplies a pulse signal to the driving motor 53 on the basis of the next driving speed data obtained by the above-mentioned operations, to control the rotation of the platen roller 47. On the other hand, if the next stencil-making is performed in a stencil-making area having a length in the vertical scanning direction different from that of the stencil-making area in the present stencil-making, the above-mentioned operations shown in FIG. 7 will be performed.

As described above, in the present embodiment, the driving speed (the feed-per-revolution) of the platen roller 47 is indirectly detected through the detecting roller 60 during the period from the start of stencil-making to the end of the stencil-making for a single stencil. The difference between the speed detected by the detecting roller 60 and the set speed is calculated, and the driving speed of the platen roller 47 is controlled and corrected to be increased or decreased in the manner that this difference is canceled.

Therefore, in the next stencil-making and any subsequent stencil-making, it is possible to reduce greatly expansion and contraction of stencil-images, which are conventionally caused by a change in the outer diameter of the platen roller based on temperature-change or change with the passage of time and caused by a change in grip force to the stencil sheet. As a result, it is possible to improve reproducibility of images that are heat-sensitively made in the stencil sheet, as compared with the prior art.

In the above-mentioned embodiment, the precision of the detection of the difference between the pulse counts by the detecting roller 60 can be made higher if the rotation number of the encoder plate 64 is raised by changing the gear ratio of the transmission gear 61 to the transmission gear 62 or the number of the slits 64*a* of the encoder plate 64 is increased.

In the above-mentioned embodiment, the next driving speed of the platen roller 47 is calculated and corrected during the period from the start of stencil-making to the end thereof for a single stencil. However, the present invention is not limited to such processing.

For example, the next driving speed of the platen roller 47 may be calculated in such a manner that: the pulse count which is necessary for the transportation of the stencil sheet 3 by the length of a single stencil in the vertical scanning direction and which is stored in the set data storage unit 101*a* is made up to plural set data separated for each given time from the start of stencil-making; the pulse count inputted from the feed-per-revolution detecting sensor 65 is detected during the period when the time for each of the set data passes; and the difference in the pulse counts between each of the detected data and each of the set data is canceled. This processing can be applied to a stencil printing machine having a function of forming images continuously, that is, a stencil printing machine in which the stencil sheet 3 is intermittently transported by the platen roller 47 to heat-sensitively form plural images in the vertical scanning direction of the stencil-making area of a single stencil.

OTHER EMBODIMENTS

Generally and as it is conventional in the representation of semiconductor devices, it will be appreciated that the various drawings are not drawn to scale from one figure to another nor inside a given figure, and in particular that the layer thickness are arbitrarily drawn for facilitating the reading of the drawings.

As described above, of course, the present invention includes various embodiments that are not described in the specification. Therefore, the technical scope of the present invention is defined by only the following claims that are reasonable from the above description.

What is claimed is:

1. A stencil printing method, using a stencil printing machine comprising a thermal head for forming a desired image in a stencil sheet heat-sensitively to make a stencil, a platen roller for transporting the stencil sheet in synchronization with the formation of the image in the stencil sheet by the thermal head, the platen roller being arranged so that the stencil sheet is sandwiched between the platen roller and the thermal head, a driving unit for rotating the platen roller at a given speed, and a detecting roller that is arranged to contact the stencil sheet at a given pressure, and is trail-rotated with the transportation of the stencil sheet by the rotation of the platen roller, comprising the steps of:

detecting a feed-per-revolution of the stencil sheet on the basis of the rotation amount of the detecting roller for a given time;

calculating a driving speed of the platen roller correspondingly to the detected feed-per-revolution and such a standard feed-per-revolution that the platen roller should be originally transported for the given time; and controlling the driving unit in the manner that the driving unit rotates the platen roller at the calculated driving speed.

2. A stencil printing method, using a stencil printing machine comprising a thermal head for forming a desired image in a stencil sheet heat-sensitively to make a stencil, a platen roller for transporting the stencil sheet in synchronization with the formation of the image in the stencil sheet by the thermal head, the platen roller being arranged so that the stencil sheet is sandwiched between the platen roller and the thermal head, a driving unit for rotating the platen roller at a given speed, and a detecting roller that is arranged to contact the stencil sheet at a given pressure, and is trail-rotated with the transportation of the stencil sheet by the rotation of the platen roller, comprising the steps of:

detecting a feed-per-revolution of the stencil sheet on the basis of the rotation amount of the detecting roller for a period from the start of stencil-making to the end thereof for a single stencil;

calculating a driving speed of the platen roller correspondingly to the detected feed-per-revolution and such a standard feed-per-revolution that the platen roller should be originally transported for the period from the start of stencil-making to the end thereof for the single stencil; and controlling the driving unit in the manner that the driving unit rotates the platen roller at the calculated driving speed.

3. The stencil printing method of claim 2, wherein whenever the driving speed is calculated, the driving speed is renewed and stored, and the driving unit is controlled in the manner that the driving unit rotates the platen roller on the basis of a newest driving speed data among the renewed and stored driving speed data.

4. A stencil printing machine comprising:

a thermal head for forming a desired image in a stencil sheet heat-sensitively to make a stencil;

a platen roller for transporting the stencil sheet in synchronization with the formation of the image in the stencil sheet by the thermal head, the platen roller being arranged so that the stencil sheet is sandwiched between the platen roller and the thermal head;

a driving unit for rotating the platen roller at a given speed;

a detecting roller that is arranged to contact the stencil sheet at a given pressure, and is trail-rotated with the transportation of the stencil sheet by the rotation of the platen roller;

a feed-per-revolution detecting unit for detecting a feed-per-revolution of the stencil sheet on the basis of the rotation amount of the detecting roller for a given time; and a control unit for calculating a driving speed of the platen roller correspondingly to the feed-per-revolution detected by the feed-per-revolution detecting unit and such a standard feed-per-revolution that the platen roller should be originally transported for the given time, and then controlling the driving unit in the manner that the driving unit rotates the platen roller at the calculated driving speed.

5. The stencil printing machine of claim 4, wherein the feed-per-revolution detecting unit comprising:

an encoder plate for transmitting the rotation of the detecting roller to the detecting roller through a gear mechanism; and a sensor for outputting pulse signals corresponding to the rotation of the encoder plate.

6. The stencil printing machine of claim 4, wherein the control unit is a microprocessor.

7. A stencil printing machine comprising:

a thermal head for forming a desired image in a stencil sheet heat-sensitively to make a stencil;

a platen roller for transporting the stencil sheet in synchronization with the formation of the image in the stencil sheet by the thermal head, the platen roller being arranged so that the stencil sheet is sandwiched between the platen roller and the thermal head;

a driving unit for rotating the platen roller at a given speed;

a detecting roller that is arranged to contact the stencil sheet at a given pressure, and is trail-rotated with the transportation of the stencil sheet by the rotation of the platen roller;

a feed-per-revolution detecting unit for detecting a feed-per-revolution of the stencil sheet on the basis of the rotation amount of the detecting roller for a period from the start of stencil-making to the end thereof for a single stencil; and a control unit for calculating a driving speed of the platen roller correspondingly to the feed-per-revolution detected by the feed-per-revolution detecting unit and such a standard feed-per-revolution that the platen roller should be originally transported for the period from the start of stencil-making to the end thereof for the single stencil, and then controlling the driving unit in the manner that the driving unit rotates the platen roller at the calculated driving speed.

8. The stencil printing machine of claim 7, comprising:

a storage unit for renewing and storing a driving speed data;

wherein the control unit controls the driving unit in the manner that the driving unit rotates the platen roller on the basis of a newest driving speed data stored in the storage unit.

9. The stencil printing machine of claim 7, wherein the feed-per-revolution detecting unit comprising:

an encoder plate for transmitting the rotation of the detecting roller to the detecting roller through a gear mechanism; and a sensor for outputting pulse signals corresponding to the rotation of the encoder plate.

10. The stencil printing machine of claim 8, wherein the feed-per-revolution detecting unit comprising:

an encoder plate for transmitting the rotation of the detecting roller to the detecting roller through a gear mechanism; and a sensor for outputting pulse signals corresponding to the rotation of the encoder plate.

* * * * *